United States Patent [19]

Yamada et al.

[11] 4,288,714

[45] Sep. 8, 1981

[54] SPARK PLUG FOR INTERNAL COMBUSTION ENGINE

[75] Inventors: Shigeyasu Yamada; Kazumi Kawamura; Shuji Nakamura, all of Nagoya, Japan

[73] Assignee: NGK Spark Plug Co., Ltd., Nagoya, Japan

[21] Appl. No.: 45,888

[22] Filed: Jun. 6, 1979

[30] Foreign Application Priority Data

Oct. 16, 1978 [JP] Japan ..... 53/127603

[51] Int. Cl.[3] ..... H01T 13/32

[52] U.S. Cl. ..... 313/142

[58] Field of Search ..... 313/141, 142

[56] References Cited

U.S. PATENT DOCUMENTS

| | | | |
|---|---|---|---|
| 961,136 | 6/1910 | Jake | 313/142 X |
| 1,620,341 | 3/1927 | Gardner | 313/142 X |
| 2,120,492 | 6/1938 | Graf | 313/140 X |
| 3,970,885 | 7/1976 | Kasima | 313/141 |

*Primary Examiner*—Palmer C. Demeo

*Attorney, Agent, or Firm*—Sughrue, Mion, Zinn, Macpeak and Seas

[57] ABSTRACT

A spark plug for an internal combustion engine with both sides of a surface, on a center electrode side, of an outer electrode and/or both side portions, on the top surface of the center electrode, form wedge-shaped projections. At least one surface having the wedge-shaped projection has no plane surface but is arcuate.

7 Claims, 8 Drawing Figures

SPARK PLUG FOR INTERNAL COMBUSTION ENGINE

BACKGROUND OF THE INVENTION

This invention relates to a spark plug for internal combustion engines for preventing quench operation of a flame nuclei due to a center electrode and an outer or ground electrode, thereby improving ignitability thereof.

There have been provided many methods for producing the quench operation of the flame nuclei due to a center electrode and an outer electrode, particularly for preventing misfires under an engine running condition in which the ignitability is low, such as during idle speed.

Within the prior art many such spark plug designs having various projections and surfaces are known. Typical are the annular surfaces shown in the inner and outer electrodes surfaces of U.S. Pat. No. 4,015,160, the annular ring and channel arrangement of U.S. Pat. No. 4,023,058 and the V-type ground electrode with a channel shown in U.S. Pat. No. 2,226,415. Additional prior art is shown in U.S. Pat. No. 3,970,885 which includes, in addition to various groove embodiments a projection provided on the ground electrode (element 36, FIG. 25). As set forth in that patent, the projection is disposed in the spark discharge area confronting the tip surface of the center electrode. The flame nuclei produced by the spark are rapidly spread out over the projection to facilitate growth of flame nuclei and easy propagation of flame. The hallmark of all these prior art devices is the modification of the ground electrode to limit the area of the grounded surface. However, it has been found that many deficiencies remain, in actual use, so these spark plugs do not satisfactorily perform, especially in an idle speed engine condition.

One method shown in my co-pending application is that an end portion of the center electrode is tapered or that a groove is formed in the end surface of the center electrode or the outer electrode surface confronting the center electrode. However, according to the above-described methods it is impossible to obtain a sufficient improvement of ignitability.

SUMMARY OF THE INVENTION

An object of the present invention is to provide a spark plug for effectively reducing the quench operation to the flame nuclei and for remarkably enhancing the ignitability thereof.

The spark plug according to the present invention is constructed so that both end surfaces of the outer electrode on the center electrode and/or both side portions of the end surface of the center electrode which are directed to the outer electrode are projected to have wedge-shaped projections, and at least one surface having wedge-shaped projections has no plane surface. The present invention will be hereinafter described referring to the accompanied drawings.

BRIEF DESCRIPTION OF THE INVENTION

DESCRIPTION OF THE PREFERRED EMBODIMENTS

Figure 1:
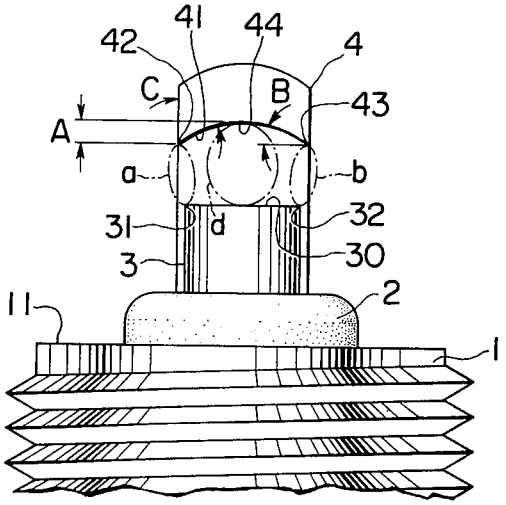
FIG. 1 shows a front view of the front portion of the spark plug as a first embodiment of the present invention.

Referring now to FIG. 1 a first embodiment according to the present invention is shown. Reference numeral 1 designates a metal body of a spark plug; 2, an insulative material; 3, a center electrode; and 4, an outer or ground electrode which is mounted on an end surface 11 of the metal body. A surface 41, on the center electrode side (inner side), of the outer electrode is concave and formed as a cylindrical surface and both sides thereof have wedge-shaped projections 42 and 43 to thereby form spark gaps with the center electrode.

In the thus constructed spark plug, because of the electric concentration phenomenon of the end of the wedge-shaped projections 42 and 43 and the spark discharge distance thereof is short, a non-uniform electric field is generated and the strength of the electric field becomes large. Therefore, most of spark discharge occurs between the projections 42 and 43 and edge portions 31 and 32 confronting the projections, respectively. Flame nuclei are produced in regions a and b positioned on both sides of the spark gap. The flame nuclei thus produced regions a and b of both sides of the spark gap are not susceptible to the quench operation of the walls of the center and outer electrodes applied to the flame nuclei during the growing period of the flame nuclei. Accordingly, ignition is positively achieved to prevent misfires in the internal combustion engine.

In contrast, in case where a spark discharge occurs in a central region d of the spark gap, a large amount of the quench effect of the end surface 30 of the center electrode and the surface of the outer electrode on the center electrode is applied to the flame nuclei so that misfires are liable to result, especially under the engine running conditions such as idle speed where difficulty of ignition is most noticed due to low engine RPM.

The above-described projections 42 and 43 must be shapened at their tips as wedges and at the same time, the tips must be positioned at outermost positions of a surface 41, confronting center electrode, of the outer electrode. A distance A in the axial direction of the center electrode from the center of the surface, confronting the center electrode, of the outer electrode to the tip end of the projection is less than about 0.3 mm. An angle B formed by a contact or tangent surface contacting the inner surface of the outer electrode at the tip of the wedge-shaped projection and the end surface of the center electrode is in a range from 5° to 15°. An angle C of the tip portion of the projection is in a range from 80° to 90°. The surface 44, on the center electrode side, of the outer electrode is not plane between the wedge-shaped projections 42 and 43. The above described numerical limitations are determined or desired in view of the durability of the spark plug. For enhancement of the ignitability, desirably, a diameter of the center electrode is the same as a width of the outer electrode or a difference therebetween is less than 1.0 mm. The reason is that if the difference deviates, increasing from the range, a spark is generated in the central portion, on the electrode side, where the spark discharge is large so that a strong quench effect occurs.

Experimental data showing differences between a spark plug according to the present invention as shown in FIG. 1 and that of the prior art in the ignitability will be hereinafter described.

Figure 2:
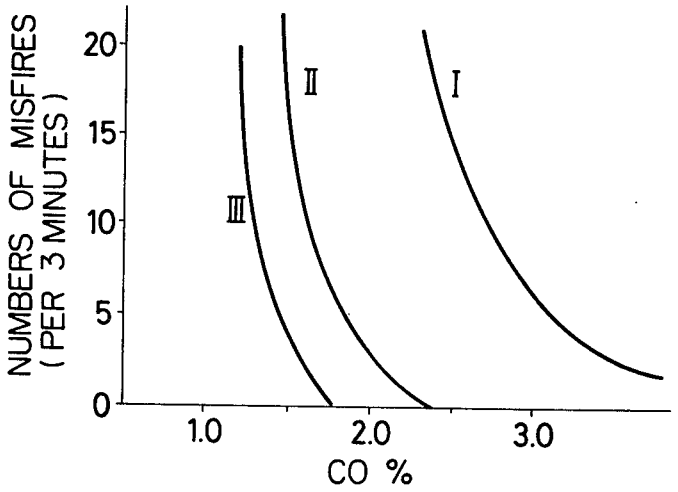
FIG. 2 shows a graph showing the ignitability.

Referring now to FIG. 2, curve (I) is a spark plug in which a spark gap between a center electrode and an outer electrode is formed by plane surfaces. (II) is a spark plug in which a longitudinal groove is formed in a surface, on a center electrode side, of an outer electrode. (III) is a spark plug in which wedge-shaped projections are formed on both edge portions an outer electrode surface confronting a center electrode according to the present invention. The engine used is a four-cycle and four-cylinder type, having a total piston displacement volume of 1600 ml and the engine is already improved for exhaust emissions. FIG. 2 is a graph showing a relationship between the number of misfires incurred and CO concentration, of the exhaust emissions, air/fuel ratio when the engine is operated in idling. As obvious from a graph shown in FIG. 2, according to the present invention, it is possible to operate the engine with the lean air/fuel ratio (low CO concentrations) and at the same time, the number of the misfires is small.

Figure 3:
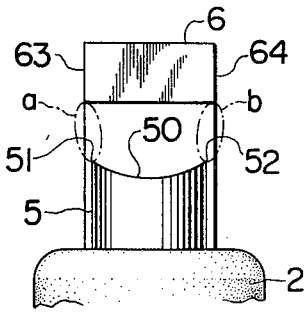
FIG. 3 shows a spark gap portion of the spark plug of the second embodiment of this invention.

FIG. 3 shows a second embodiment of the present invention wherein wedge-shaped portions 51 and 52 of the top surface 50 of the center electrode 5 are projected. These portions are in alignment with side portions 63 and 64 of the outer electrode 6. Also, in the spark plug of this embodiment, the spark discharge is generated in regions a and b of both sides of the spark gap. As in the first embodiment, an enhancement of the ignitability is achieved.

Figure 4:
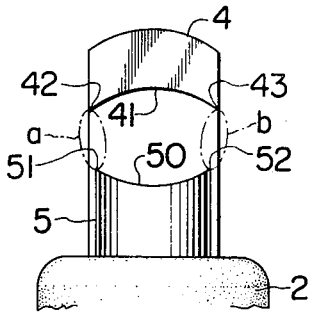
FIG. 4 shows a spark gap portion of the spark plug of the third embodiment of this invention.

FIG. 4 shows a third embodiment of the present invention, wherein wedge-shaped projections 51, 52, 42 and 43 are formed on both the top end surface 50 of the center electrode 5, of outer electrode 4. Also, in this embodiment, a spark discharge occurs in region a and b on both sides of the spark gap.

Figure 5:
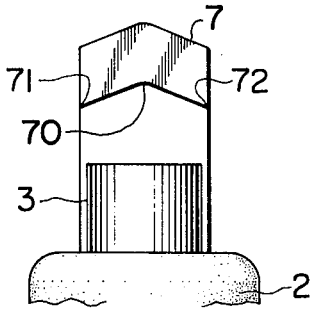
FIGS. 5, 6 and 7 show spark gap portions of the spark plugs of other embodiments.
Figure 6:
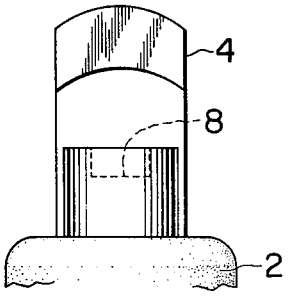
Figure 7:
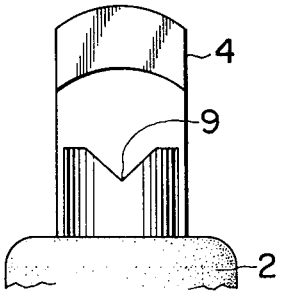

FIG. 5 shows a fourth embodiment in which a surface, on the center electrode side, of the outer electrode 7 is V-shaped in a concave manner and as a result, both sides 71 and 72 become wedge-shaped projections. FIGS. 6 and 7 show combinations between an outer electrode 4 having a wedge-shaped projection in both sides of a surface and on the center electrode a rectangular concave 8 and a groove 9, respectively. These modifications have the same spark discharge generated position and ignitability enhancement as the first embodiment.

Figure 8:
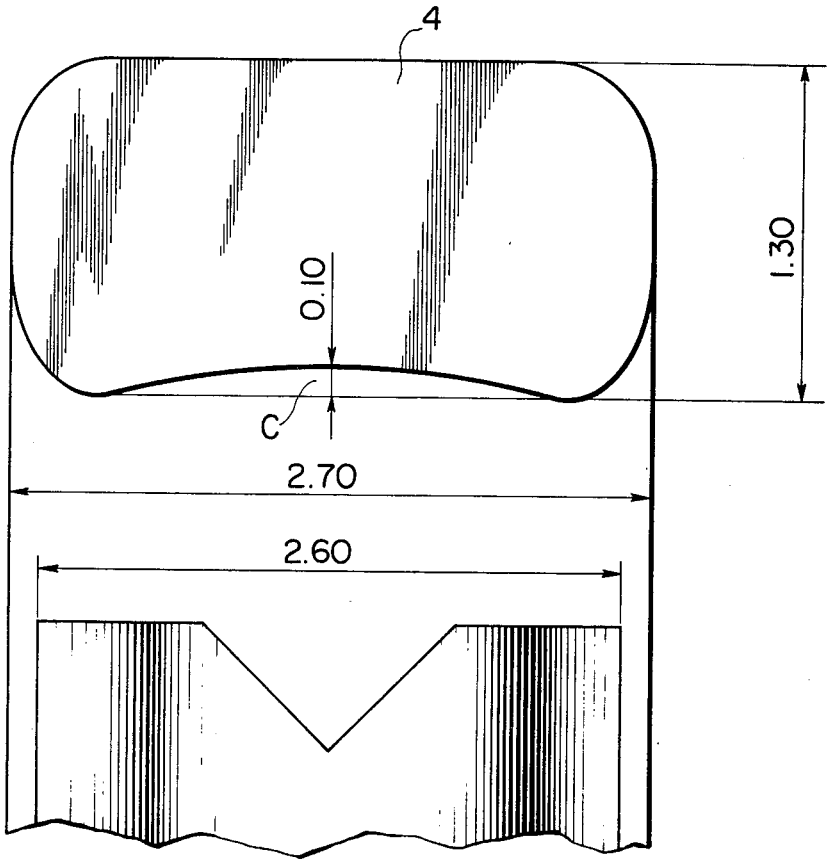
FIG. 8 shows a front view of a practical embodiment of this invention.

FIG. 8 shows an embodiment of a spark plug which is practical, according to the present invention. The spark plug according to the present invention will be practically used in this form. That is, the apexes of the wedge-shape are rounded by machining and the maximum depth of concave portion of the outer electrode 4 is very small. A V-shaped groove 9 is formed in the center electrode. Dimensions in mm used in FIG. 8 are only for reference.

As mentioned above, a spark plug of the present invention is constructed so that at least wedge-shaped projections are formed on both side surfaces, on the center electrode, of the outer electrode or both side portions, on both sides of the outer electrode, of the end surface of the center electrode, as a result of which the spark discharge is positively generated in the both side regions of the spark gap. Therefore, the quench effect of the center electrode and the outer electrode is very small to thereby enhance the ignitability.

It is apparent that modifications can be made without departing from the scope of this invention.

What is claimed is:

1. A spark plug for an internal combustion engine comprising an insulating body member, a center electrode extending from said body member and having a top surface, said top surface of said center electrode configured as a concave surface, an outer electrode having an inner surface facing said top surface, said outer electrode inner surface configured as a rounded concave surface opposing said top surface, said rounded concave surface having wedge-shaped edge projections forming spark gaps with the opposing center electrode top concave surface.

2. The spark plug of claim 1 wherein the distance from the edge projection to the center of said rounded concave surface is less than 0.3 mm.

3. The spark plug of claim 1 wherein the angle formed by a tangent to said rounded concave surface and an end surface of said electrode is in the range of 5° to 15°.

4. The spark plug of claim 1 wherein said center electrode is circular and has a diameter substantially equal to the width of said outer electrode.

5. The spark plug of claim 1 wherein said concave surface on said top surface is V-shaped.

6. The spark plug of claim 1 wherein said concave surface on said top surface is circular.

7. The spark plug of claims 1 or 5 wherein said rounded concave surface has gradually tapered edge portions, said edge portions forming wedge-shaped projections on the outer electrode confronting said top surface.

* * * * *